US012054995B2

(12) United States Patent
Hocking

(10) Patent No.: US 12,054,995 B2
(45) Date of Patent: Aug. 6, 2024

(54) LOCKING APPARATUS FOR DRILLING RIG COMPONENTS

(71) Applicant: Montrae Mining Pty Ltd, Airport Estate Albury (AU)

(72) Inventor: Monte Hocking, Airport Estate Albury (AU)

(73) Assignee: MONTRAE MINING PTY LTD, Airport Estate Albury (AU)

( * ) Notice: Subject to any disclaimer, the term of this patent is extended or adjusted under 35 U.S.C. 154(b) by 1 day.

(21) Appl. No.: 18/048,222

(22) Filed: Oct. 20, 2022

(65) Prior Publication Data

US 2023/0125337 A1 Apr. 27, 2023

(30) Foreign Application Priority Data

Oct. 22, 2021 (AU) ..... 2021903390

(51) Int. Cl.
*E21B 17/043* (2006.01)
*E21B 17/046* (2006.01)

(52) U.S. Cl.
CPC ..... *E21B 17/043* (2013.01); *E21B 17/046* (2013.01)

(58) Field of Classification Search
CPC .. E21B 17/043; E21B 17/0465; E21B 17/046; E21B 17/03
See application file for complete search history.

(56) References Cited

U.S. PATENT DOCUMENTS 5,101,906 A * 4/1992 Carlin ..... E21B 17/043 166/380
2009/0301711 A1 12/2009 Jagert et al.
2011/0214877 A1* 9/2011 Stringfellow ..... E21B 17/085 166/341
2013/0146305 A1* 6/2013 Dupal ..... E21B 17/046 166/380

(Continued)

FOREIGN PATENT DOCUMENTS

WO 2019/234519 A1 12/2019

OTHER PUBLICATIONS

Australian Search Report for corresponding Australian Application No. 2021903390 dated Aug. 3, 2022.

*Primary Examiner* — David Carroll
(74) *Attorney, Agent, or Firm* — Pearne & Gordon LLP

(57) ABSTRACT

The present application relates to a locking apparatus for locking axial ends of first and second drilling rig components in a connected state, the connected state established by sufficiently rotating the first drilling rig component relative to the second drilling rig component in a first direction. The apparatus includes a first locking means that enables the first and second drilling rig components to be locked in their connected state by causing, during rotation of the first drilling rig component in the first direction, the locking apparatus to engage with the first drilling rig component in a configuration that prevents the first drilling rig component from rotating in a direction opposite to the first direction. The apparatus further includes a second locking means that enables the locking apparatus to be prevented from rotation relative to the second drilling rig component, including during rotation of the first drilling rig component in the first direction, the locking apparatus thereby preventing relative rotation between the first and second drilling rig components.

16 Claims, 6 Drawing Sheets

(56) References Cited

U.S. PATENT DOCUMENTS

| | | | | |
|---|---|---|---|---|
| 2016/0047502 | A1 | 2/2016 | Varghese et al. | |
| 2018/0058167 | A1 | 3/2018 | Finol et al. | |
| 2018/0230758 | A1* | 8/2018 | Nelson | E21B 17/043 |
| 2020/0109607 | A1* | 4/2020 | Mackay | E21B 19/16 |

* cited by examiner

LOCKING APPARATUS FOR DRILLING RIG COMPONENTS

FIELD OF THE INVENTION

The present invention relates to a locking apparatus for two drilling rig components configured to be connected by rotary engagement and, in particular, to a ratchet locking apparatus that locks the components in their connected state by preventing the components from rotatably disengaging. The present invention further relates to a drilling rig incorporating the locking apparatus, and a method of assembling the drilling rig.

BACKGROUND OF THE INVENTION

Mining applications often require the drilling of vertical holes in the earth's subsurface, and a drilling rig is typically used for this task. A drilling rig typically comprises a rotary head which turns a vertical drill string. The drill string is connected to the rotary head at its upper end and includes a drill bit at its opposed lower end. The drill string itself is usually made up of multiple drill sections (also referred to herein as drill rods) where the number of sections used depends upon the required depth of the bore hole. Accordingly, when drilling a bore hole, a typical requirement is to connect at least two drill rods end-to-end to form an extended drill string.

For example, a first drill rod may be connected to the rotary head and used to drill a bore hole to an initial depth. The rotary head may then be screwed off the first drill rod such that the first drill rod remains in the bore hole, allowing the rotary head to be raised. Once the rotary head is raised, the second drill rod can be screwed on to the rotary head at its upper end, and to the first drill rod at its lower end, and drilling with the extended drill string (comprising two drill rods) may be re-commenced to create a deeper bore hole. The same process may be repeated so as to attach additional drill rods to further extend the drill string, until the desired depth is reached.

When the bore hole is at the desired depth, the procedure can be reversed with the drill string being rotated out of the bore hole and each drill rod being progressively disconnected, until finally, the drill rod that was mounted first is removed from the drilled bore hole.

The connecting portion between the rotary head and drill rod, and between each drill rod, typically includes a similar connection means, i.e. a male and female portion configured to engage. For example, the male connecting portion at one end of each rod is typically a frusto-conical projection including an external thread, and the female portion at the opposite end of each rod (and also at the connecting portion of the rotary head) is typically a bore that includes a corresponding frusto-conical shape with an internal thread.

However, there are typically additional components used. For example, where connecting portions associated with two components have different sizes or different thread characteristics, as is often the case, a cross-over sub may need to be selected and utilized to enable the two components to be connected. A cross-over sub is a mechanical part with threaded connections on opposite ends that can be utilized, for example, at the connection between the rotary head and the first drill rod, and/or at the connection between adjacent drill rods forming the drill string.

In some applications, a shock cushion sub (also referred to herein as a cushion sub) may be utilized between the rotary head and a first drill rod, or between the rotary head and a first cross-over sub to which a first drill rod is connected. In other words, the cushion sub may be connected to the rotary head and, in turn, the first drill rod may be connected to the cushion sub using a cross-over sub. The shock cushion sub is typically used to absorb vibrations through the drill string, i.e. prevent the transmission of vibration forces to the rotary head.

Accordingly, there can be multiple different connection configurations at the rotary head end of the drill rig. For example, in one configuration, a cross-over sub can be used to connect a first drill rod to a cushion sub connected to the rotary head. In a further configuration, the first drill rod may be connected directly to the cushion sub. In another configuration, a cross-over sub may be used to connect the first drill rod directly to the rotary head (i.e. without the use of a cushion sub). In a yet further configuration, the first drill rod may be connected directly to the rotary head (i.e. without the use any subs). A common problem that occurs at the rotary head end of the drill rig, when reverse rotation is applied, is at least one of the components is caused to turn in both directions under pressure during the drilling process. This results in the connection at that point becoming loose and potentially adversely affecting the drilling process, or at least requiring the drilling process to be stopped until the components can be tightened again.

For this reason, it is necessary to ensure that the two components that are prone to unscrewing and becoming loose are prevented from rotating relative to one another. Various attempts have been made to prevent the rotation of one component relative to another, including by welding one or more lugs between the two components, or using a thread sealant to join the components. However, there are problems associated with both of these known solutions.

Regarding the welding solution, a problem arises from the fact that the drill rig must be isolated during the welding process, and the welded lug must be removed (typically cut off with a grinder) to subsequently separate the components. Moreover, welding poses an occupational health and safety concern, and requires a skilled operator (who are often in short supply), thus giving rise to delays and additional cost.

Similar problems arise when using the thread sealant solution in that to disconnect the components, an operator is required to "oxyheat" the subs so as to liquefy the thread sealant and allow disconnection, which also gives rise to additional delay and expense.

An additional solution for addressing some of the above-mentioned problems involves the use of a "lock ring" adapted to fit over (i.e. journal around) the connection between the two connecting components and lock the components together, thereby preventing them from rotation relative to one another during a drilling operation. In particular, the lock ring includes a first part having an internal configuration that substantially complements an external dimension of a first component of the two connecting components, such that when the first part of the lock ring is engaged with the first component it is able to slide axially but is prevented from rotating with respect to the first component. Similarly, the lock ring includes a second part, which is integrally formed with the first part, having an internal configuration that substantially complements an external dimension of the second component such that when the second part of the lock ring is engaged with the second component it is able to slide axially but is prevented from rotating with respect to the second component. In this way, the lock ring becomes an effective tool for preventing relative rotation between the first and second components during a drilling operation.

Typically, the internal configuration of the first part of the lock ring and the corresponding external dimension of the first component end zone is a polygonal cross-sectional shape, and the internal configuration of the second part of the lock ring and the corresponding external dimension of the second component end zone is splined). During assembly, the locking ring is attached to the first component only, and the two drilling rig components are configured to engage using the frusto-conical threaded connection means described earlier. Whilst these components are being tightened (e.g. where one of the components is a rotary head, by rotating the rotary head), the first part of the lock ring remains journaled around the end zone of the first component whilst the second part of the lock ring extends out axially from the first part. Once the two drilling rig components are substantially engaged, an operator may then align the internal splines associated with the second part of the lock ring with the splines at the end zone of the second drilling rig component. Once the splines are aligned, the lock ring can slide in an axial direction towards the second component such that the splines are caused to engage.

Once the lock ring has been moved sufficiently in the axial direction towards the second component, i.e. when the first part of the lock ring is engaging the end zone of the first component and the second part of the lock ring is engaging the end zone of the second component, the lock ring acts to prevent relative rotation between the first and second components.

However, a problem that is often encountered when assembling two components of a drill rig in this manner, is the difficulty associated with axially aligning the vertically extending (radially projecting) splines associated with the second part of the lock ring with the corresponding splines associated with the end zone of the second component (i.e. prior to axially sliding the lock ring towards the second component). This is due to the inability of the lock ring to be rotated once it is mounted to the end zone of the first component. The only way the lock ring can be rotated is by rotating the first component. Accordingly, aligning the splines can be very difficult in the field, and whilst it is possible to reverse rotate the first component to assist in aligning the splines, this will result in a loose connection between the components because the frusto-conical threaded connection becomes slightly disengaged. A loose connection may give rise to additional problems including increased noise and vibration, and additional wear and tear.

It is an object of the present invention to overcome at least some of the aforementioned problems or to provide the public with a useful alternative.

The reference to any prior art in this specification is not, and should not be taken as, an acknowledgement or any suggestion, that the prior art forms part of the common general knowledge.

SUMMARY OF THE INVENTION

In a first aspect, the present invention provides a locking apparatus for locking axial ends of first and second drilling rig components in a connected state, the connected state established by sufficiently rotating the first drilling rig component relative to the second drilling rig component in a first direction, the apparatus including, a first locking means that enables the first and second drilling rig components to be locked in their connected state by causing, during rotation of the first drilling rig component in the first direction, the locking apparatus to engage with the first drilling rig component in a configuration that prevents the first drilling rig component from rotating in a direction opposite to the first direction, and a second locking means that enables the locking apparatus to be prevented from rotation relative to the second drilling rig component, including during rotation of the first drilling rig component in the first direction, the locking apparatus thereby preventing relative rotation between the first and second drilling rig components.

It is to be understood that reference to a "first" and a "second" drilling rig component is not intended to signify the order of these components along the length of the drilling rig. In other words, use of the word "first" does not necessarily indicate that this component is the first drilling rig component in the drilling rig. For example, the first drilling rig component is not necessarily the rotary head of the drilling rig, but could be any component along the length of the drilling rig including a drill rod, or any one of the subs. Accordingly, the reader will appreciate the first and second drilling rig components could be any two adjacent components positioned along the entire length of the drilling rig.

It should also be understood that reference to rotation of the first drilling rig component relative to the second drilling rig component in a first direction does not necessarily restrict the present invention to the rotation of solely the first drilling rig component, whilst the second drilling rig component remains stationary (although this would typically be the case). For example, such rotation could also result from rotation of both components in opposite directions simultaneously.

In an embodiment, the locking apparatus includes a single locking ring, and the first locking means is a ratchet type locking mechanism comprising a set of ratchet teeth associated with the locking ring and configured to engage with a complementary set of ratchet teeth associated with the first drilling rig component. In this way, when the first drilling rig component has been drawn sufficiently towards the locking ring during rotation of the first drilling rig component in the first direction, the teeth come into contact and rotatably interact, wherein such interaction continues to allow rotation of the teeth and hence the first drilling rig component in the first direction, thereby enabling the two components to become fully connected, but not in the opposite direction, thereby preventing the two components from disengaging from their connected state.

In an embodiment, the second locking means is a spline type locking mechanism comprising a set of radially projecting splines associated with the locking ring and configured to engage with a complementary set of radially projecting splines associated with the second drilling rig component, the splines allowing axial motion of the locking ring relative to the second drilling rig component but preventing rotational motion of the locking ring.

In an embodiment, the locking ring includes internal splines and the second drilling rig component includes corresponding external splines.

In an embodiment, the locking ring is secured to the second drilling rig component prior to connecting the first drilling rig component to the second drilling rig component, by axially aligning the internal splines of the locking ring with the external splines of the second drilling rig component and then sliding the locking ring in an axial direction towards the second drilling rig component so that the respective splines engage.

In an embodiment, the locking ring encounters a circlip journaled around the second drilling rig component a predetermined distance inward from the engaging end of the second drilling rig component, the circlip preventing sliding motion of the locking ring beyond the circlip, the circlip thereby providing a means of abutment for the locking ring.

In an embodiment, a rubber wedge or O-ring is disposed between the locking ring and circlip to absorb vibration and prevent wear and tear that would otherwise result from direct contact between the locking ring and circlip.

In an embodiment, the location of the circlip is such that its predetermined distance inward from the axial end of the second drilling rig component substantially corresponds with the length of the locking ring such that when the locking ring is mounted to the second drilling rig component, the teeth associated with the locking ring extend substantially flush with the abutment surface of the second drilling rig component axial end. In this way, as the first drilling rig component and the second drilling rig component are drawn closer together towards their connected state, the teeth associated with the ratchet type locking mechanism eventually commence their engagement to prevent rotation of the first drilling rig component in the opposite direction, thereby locking the components.

In an embodiment, when the circlip is disengaged, the locking ring is allowed to slide axially away from the first drilling rig component in the direction of the second drilling rig component. In this way, the first and second drilling rig components may be unlocked by disengaging the circlip which causes the ratchet teeth associated with the locking ring to move away and become disengaged from the ratchet teeth associated with the first drilling rig component, thereby enabling the first drilling rig component to be rotated in the opposite direction.

In an alternative embodiment, the locking apparatus includes a first locking ring associated with the first drilling rig component and a second locking ring associated with the second drilling ring component, and the first locking means is a ratchet type locking mechanism comprising a set of ratchet teeth associated with the first locking ring and configured to engage with a complementary set of ratchet teeth associated with the second locking ring.

In the alternative embodiment, the second locking means is a spline type locking mechanism comprising a set of radially projecting splines associated with the second locking ring and configured to engage with a complementary set of radially projecting splines associated with the second drilling rig component, the splines allowing axial motion of the second locking ring relative to the second drilling rig component but preventing rotational motion of the second locking ring.

In the alternative embodiment, the first and second locking ring include internal splines and the respective first and second drilling rig components include corresponding external splines.

In the alternative embodiment, the first locking ring is secured to the first drilling rig component and the second locking ring is secured to the second drilling rig component prior to connecting the first drilling rig component to the second drilling rig component, by axially aligning the internal splines of each locking ring with the external splines of the corresponding drilling rig component and then sliding the locking rings in an axial direction so that the respective splines engage.

In the alternative embodiment, the first locking ring encounters a circlip journaled around the first drilling rig component a predetermined distance inward from the engaging end of the first drilling rig component, the circlip preventing sliding motion of the first locking ring beyond the circlip, the circlip thereby providing a means of abutment for the first locking ring.

In the alternative embodiment, a rubber wedge or O-ring is disposed between the first locking ring and circlip to absorb vibration and prevent wear and tear that would otherwise result from direct contact between the first locking ring and circlip.

In the alternative embodiment, the second locking ring encounters a shoulder associated with the second drilling rig component a predetermined distance inward from the engaging end of the second drilling rig component, the shoulder preventing sliding motion of the second locking ring beyond the shoulder, the shoulder thereby providing a means of abutment for the second locking ring.

In the alternative embodiment, a rubber wedge or O-ring is disposed between the second locking ring and shoulder to absorb vibration and prevent wear and tear that would otherwise result from direct contact between the second locking ring and shoulder.

In an embodiment, each drilling rig component and locking ring is substantially cylindrically shaped and thereby has a substantially circular edge surface at each engaging end thereof such that when a set of ratchet teeth is associated with the engaging end, the ratchet teeth are arranged around the edge surface in a substantially circular arrangement with teeth projecting outwardly from the surface in a substantially axial direction.

In an embodiment, there is an even number of teeth in each set of teeth disposed around each engaging end, and the number of teeth increases as the size of the first drilling rig component and locking ring increases.

In an embodiment, the teeth protrude axially at an angle of between 30 and 50 degrees from the edge surface. In an embodiment, the teeth protrude axially at an angle of 40 degrees from the edge surface.

In an embodiment, the first and second drilling rig components are connected by rotatably engaging a frusto-conical projection extending from the axial end of one drilling rig component with a corresponding frusto-conical bore in the axial end of the other drilling rig component, wherein the connected state is achieved once an abutment surface at a base of the projection comes into contact with a corresponding abutment surface at the axial end of the drilling rig component that includes the frusto-conical bore.

In an embodiment, the locking apparatus further includes an annular protector for use when the first and second drilling rig components are locked in their connected state, the annular protector fitted over any exposed locking means (e.g. exposed engaging ratchet teeth) to prevent ingress of particles (e.g. dust) during a drilling operation.

In an embodiment, the first drilling rig component is a rotary head and the second drilling rig component is a cross-over sub.

In an embodiment, the first drilling rig component is a rotary head and the second drilling rig component is a cushion sub.

In an embodiment, the first drilling rig component is a rotary head and the second drilling rig component is a first drill rod.

In an embodiment, the first drilling rig component is a cross-over sub and the second drilling rig component is a first drill rod.

In an embodiment, the first drilling rig component is a cross-over sub and the second drilling rig component is a drill bit.

In an embodiment, the first drilling rig component is cushion sub and the second drilling rig component is a first drill rod.

In an embodiment, the first drilling rig component is a cushion sub and the second drilling rig component is a cross-over sub.

In an embodiment, the first drilling rig component is a first drill rod and the second drilling rig component is a second drill rod.

In an embodiment, the first drilling rig component is a first drill rod and the second drilling rig component is a cross-over sub.

In an embodiment, the first drilling rig component is a drill rod and the second drilling rig component is a drill bit.

In a second aspect, the present invention provides a drilling rig including:

a first drilling component, a second drilling component, and a locking apparatus for the first and second drilling components, the locking apparatus configured in accordance with any one or more of the preceding statements.

In a third aspect, the present invention provides a method of assembling the drilling rig configured in accordance with the preceding statement, the method including:

mounting the locking apparatus to the second drilling component such that the locking apparatus, or a locking ring associated therewith, is prevented from rotation relative to the second drilling rig component;

connecting the first drilling rig component to the second drilling component by rotating at least the first drilling rig component in said first direction and thereby causing the two components to rotatably engage, wherein during rotation of the first drilling rig component in the first direction, the first locking means associated with the locking apparatus is caused to engage with the first drilling rig component in a manner that allows further rotation of the first drilling rig component in the first direction but prevents the first drilling rig component from rotation in a direction opposite to the first direction; and continuing to rotate the first drilling rig component until the first and second drilling rig components are in their connected state.

In the embodiment involving a single locking ring, mounting the locking apparatus to the second drilling component includes axially aligning internal splines associated with the locking apparatus with corresponding external splines associated with the second drilling component, and axially sliding the locking apparatus in a direction towards the second drilling component, the splined engagement preventing rotation of the locking apparatus relative to the second drilling rig component.

In the embodiment involving a single locking ring, prior to mounting the locking ring to the second drilling component, the method further includes:

mounting a circlip and then a rubber wedge to the second drilling component such that the circlip and rubber wedge are journaled around the second drilling rig component a predetermined distance inward from an axial end of the second drilling rig component, the circlip preventing sliding motion of the locking ring beyond the circlip and the rubber wedge absorbing vibration and preventing wear and tear that would otherwise result from direct contact between the locking ring and circlip.

In the embodiment involving a single locking ring, connecting the first drilling rig component to the second drilling rig component includes rotatably engaging a frustoconical projection extending from the axial end of the second drilling rig component with a corresponding frustoconical bore in the axial end of the first drilling rig component, the axial end of the second drilling rig component including an abutment shoulder with which the axial end of the first drilling rig component abuts when the first and second drilling rig components are in their connected state, the abutment shoulder preventing further rotation of the first drilling rig component in the first direction.

In the embodiment involving a single locking ring, the method further includes:

once the first and second drilling rig components are in their connected state and further rotation of the first drilling rig component in the first direction is prevented, and the ratchet teeth are engaged to prevent rotation of the first drilling rig component in the opposite direction, fitting an annular protector over the exposed engaging ratchet teeth to prevent ingress of dust and other material during a drilling operation.

In the embodiment involving a single locking ring, the method further includes disassembling the locking system by disengaging the circlip, the locking ring then allowed to slide axially away from the first drilling rig component in the direction of the second drilling rig component. In this way, the first and second drilling rig components may be unlocked by disengaging the circlip which causes the ratchet teeth associated with the locking ring to move away and become disengaged from the ratchet teeth associated with the first drilling rig component, thereby enabling the first drilling rig component to rotate in the opposite direction.

BRIEF DESCRIPTION OF THE DRAWINGS

Features of the present disclosure are illustrated by way of example and not limited in the following figure(s), in which like numerals indicate like elements, in which.

DETAILED DESCRIPTION OF THE EMBODIMENT(S) OF THE INVENTION

Figure 1:
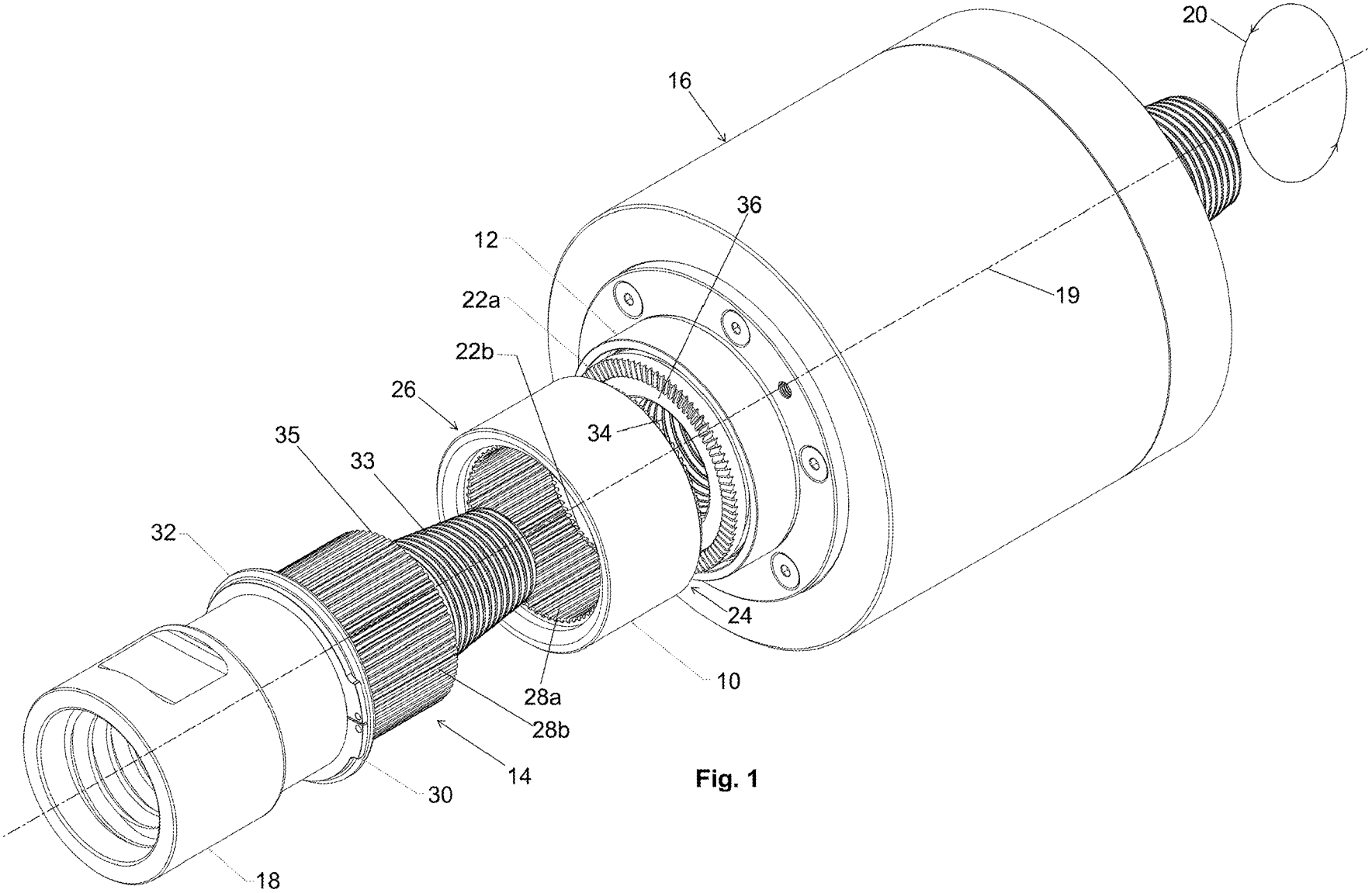
FIG. 1 illustrates a first exploded, perspective view of a portion of a drilling rig comprising two drilling rig components and a locking apparatus according to an embodiment of the present invention.
Figure 2:
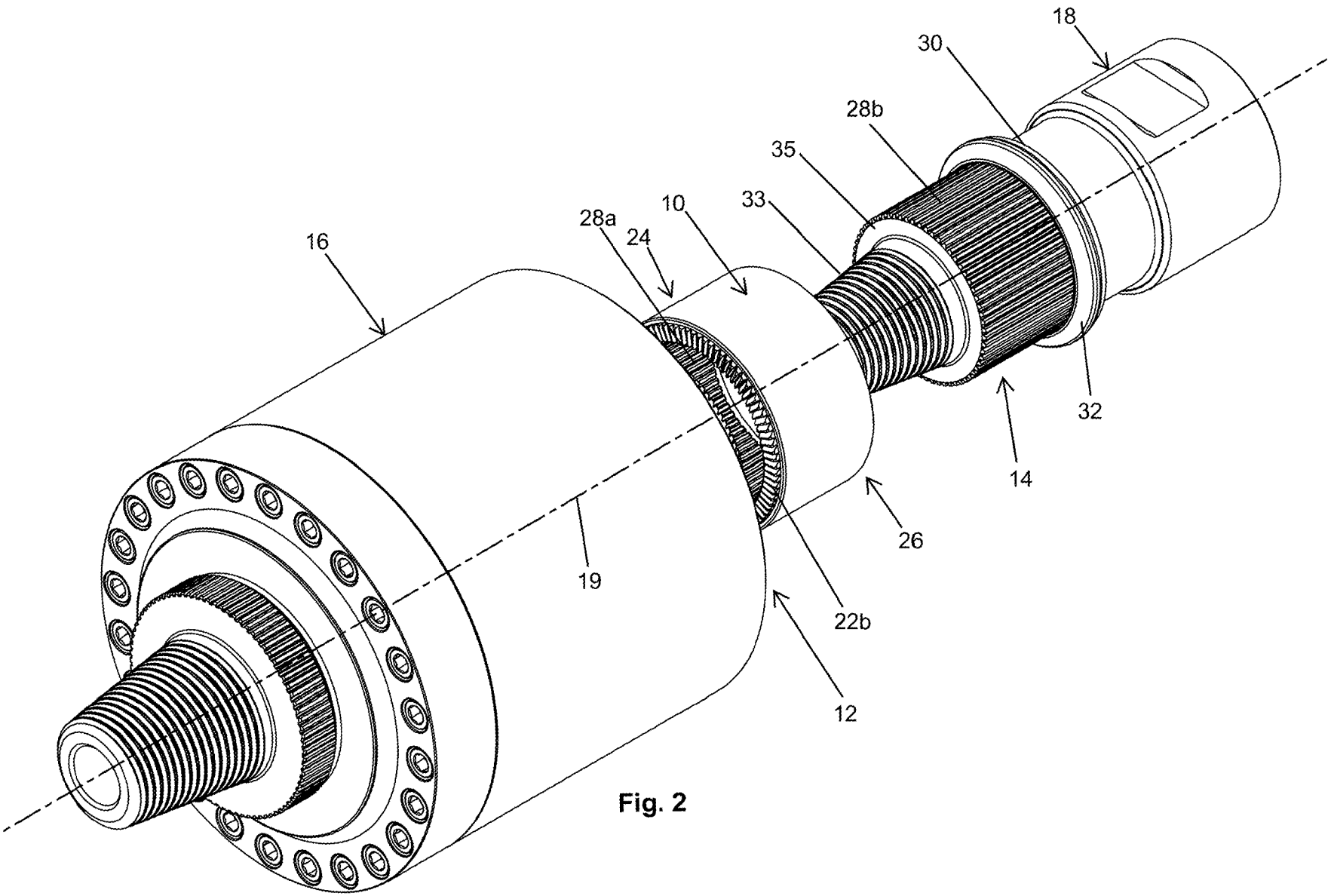
FIG. 2 illustrates a second exploded, perspective view of the drilling rig portion illustrated in FIG. 1.

For simplicity and illustrative purposes, the present disclosure is described by referring to an embodiment thereof. In the following description, numerous specific details are set forth in order to provide a thorough understanding of the present disclosure. It will be readily apparent however, that the present disclosure may be practiced without limitation to these specific details. In other instances, some methods and structures have not been described in detail to avoid unnecessarily obscuring the present disclosure.

As used herein, the terms “a” and “an” are intended to denote at least one of a particular element, the term "includes" means includes but not limited to, the term "including" means including but not limited to, and the term "based on" means based at least in part on.

The present invention relates to a locking apparatus (10) for preventing rotation (disengagement) between the axial ends (12) and (14) of respective first and second drilling rig components (16) and (18) connected coaxially along a longitudinal axis (19). The drilling rig components (16) and (18) are rotatably connected, i.e. by rotation of the first drilling rig component 16 relative to the second drilling rig component (18) in a first rotational direction (20) until the first and second drilling rig components are in a connected state, as described in greater detail below.

The locking apparatus (10) is used to ensure that the established connection between alternatively configured drilling rig components is maintained. The two drilling rig components that are connected may include, but are not limited to, a rotatory head, a cross-over sub, a cushion sub, a drill rod, and a drill bit.

The present invention further relates to a drilling rig including the first and second drilling rig components (16) and (18), and the locking apparatus (10) for locking the first and second drilling components in their connected state.

FIGS. 1 to 5 illustrate the use of a locking apparatus in the form of a locking ring (10) for locking (i.e. preventing disengagement between) a cushion sub component (16) and a cross-over sub component (18). As mentioned above, these represent two examples of drilling rig components, but the locking ring (10) can be used to lock other components of a drilling rig.

It will be appreciated that the locking ring (10) is in the form of an annular ring configured to be associated with the cross-over sub component (18) in a manner that prevents rotation of the locking ring (10) relative to the component (18). The manner in which this is achieved will be described in greater detail below. The locking apparatus (ring) further includes teeth (22*a*) which form part of a first locking means. The first locking means further includes teeth (22*b*) associated with the first drilling rig component (16) and enables the two components (16) and (18) to be locked in their connected state by causing, during rotation of the component (16) in the first direction (20), the teeth (22*a*) of the locking ring (10) to engage with the teeth (22*b*) of the first drilling rig component (16). It will become apparent that this engagement utilising the first locking means is such that the component (16) is prevented from rotation in a rotational direction opposite to the first direction (20). The locking ring (10) thereby prevents, by action of the first locking means, relative rotation between the first (16) and second (18) components once the components have been rotationally engaged and in their connected state.

As shown in FIG. 1, the locking ring (10) includes a first axial end (24) which includes the teeth (22*a*) associated with the first locking means, and a second axial end (26) which includes internal vertical splines (28*a*) forming part of a second locking means which also includes external vertical splines (28*b*) of the second drilling rig component (18). The respective splines are configured to engage and prevent rotation of the locking ring (10) relative to the second drilling rig component (18).

It is to be understood that reference to "vertical", when describing the splines (28*a*) and (28*b*), or other splines described herein in a similar manner, is representative of the direction of splines when the drilling rig components are assembled in a vertical arrangement (e.g. during a drilling operation). These splines may also be characterised as projecting radially (i.e. from an internal or external surface of a drilling rig component and/or locking ring) and extending axially (i.e. in the same direction as longitudinal axis (19)).

Accordingly, it will be appreciated that in addition to the teeth (22*a*) associated with the locking ring (10), the first locking means includes a set of teeth (22*b*) associated with the first drilling rig component (16). Accordingly, the first locking means is a ratchet type locking mechanism whereby the locking ring (10) includes a set of ratchet teeth (22*a*) and the first drilling rig component (16) includes a complimentary set of ratchet teeth (22*b*). In this way, when the locking ring (10) engages the second drilling rig component (18), and the first drilling rig component has been drawn sufficiently towards the locking ring (10) during rotation of the component (16) in the first rotational direction (20), the two sets of teeth (22*a*) and (22*b*) will eventually come into contact and start to rotatably interact. Such interaction continues in order to allow rotation of the first drilling rig component (16) in the first direction (20), until the two components become fully connected and the first drilling rig component (16) is prevented from further rotational motion in the first direction (20). The locking ring (10) prevents rotation of the first drilling rig component (16) in the opposite direction, thereby preventing the two components (16) and (18) from disengaging once in their connected state.

As described above, at a drill site (not shown), the drilling rig components (16) and (18) will generally be assembled such that they extend substantially vertically. Accordingly, the rachet type mechanism (i.e. teeth (22*a*) associated with the locking ring (10) and teeth (22*b*) associated with the first drilling rig component (16)) will extend substantially horizontally such that the first axial end (24) of the locking ring (10) includes a horizontal set of ratchet teeth (22*a*), and the engaging axial end (12) of the first drilling rig component (16) also includes a horizontal set of ratchet teeth (22*b*). In the embodiment shown, the components (16) and (18) are substantially cylindrical, and the respective teeth (22*a*) and (22*b*) protrude axially from each engaging end of the component (16) and the locking ring (10) in a substantially annular arrangement. In an embodiment, there are an even number of teeth disposed around each engaging end of the first drilling rig component (16) and locking ring (10), and the skilled addressee will appreciate that the number of teeth required will increase as the size of the first drilling rig component (16) and locking ring (10) increases.

The angle of protrusion of the teeth (22) from each of the engaging ends of the component (16) and locking ring (10) is such that the teeth (22) enable rotation in one direction (e.g. direction (20)), but prevent rotation in the opposite rotational direction, as described above. According to an embodiment, the teeth (22*a*) and (22*b*) protrude axially at an angle of between 30 and 50 degrees, e.g. 40 degrees.

In the embodiment shown in FIGS. 1 to 5, the second locking means, which enables the locking ring (10) to slide axially relative to the end (14) of the second drilling rig component (18) whilst preventing rotation of the locking ring (10), includes internal vertical splines (28*a*) associated with the second axial end (26) of the locking ring (10) and corresponding external vertical splines (28*b*) associated with the axial end (14) of the second drilling component (18). It will be appreciated that the locking ring (10) is secured to the second drilling rig component (18) prior to connecting the first drilling rig component (16) to the second drilling rig component (18) by way of rotational engagement, and this is achieved by axially aligning the internal vertical splines (28*a*) of the locking ring (10) with the external vertical splines (28*b*) of the second drilling rig component (18)

before sliding the locking ring (10) in an axial direction towards the second drilling rig component (18) so that the respective splines engage.

When assembling a drilling rig including components (16) and (18) and locking ring (10), the second drilling rig component (18) requires a means of preventing axial movement of the locking ring (10) beyond a certain point as the locking ring (10) is fitted onto the second drilling rig component (18), to ensure the locking ring (10) remains in the desired position for locking the first drilling rig component (16). In this regard, and as shown in FIGS. 1 to 5, the second axial end (26) of the locking ring (10) encounters a circlip (30) journaled around the second drilling rig component (18) a predetermined distance from the axial end (14) of the second drilling rig component (18), the circlip (30) preventing sliding (axial) motion of the locking ring (10) beyond the circlip (30). In this way, the circlip (30) provides a means of abutment for the second axial end (26) of the locking ring (10). As also shown in the drawings, a rubber wedge or O-ring (32) may be positioned between the locking ring (10) and circlip (30) to absorb vibration and prevent wear and tear that would otherwise result from direct contact between the locking ring (10) and the circlip (30).

Accordingly, the steps of assembling the drilling rig components (16) and (18) together with the locking ring (10) should now be appreciated. In this regard, the steps include:

- fitting the circlip (30) and O-ring (32) onto the second drilling rig component (18) at the relevant position inward from the axial end (14) of the second drilling rig component (18)—this position could be marked or indented to enable an operator to see where the circlip (30) and O-ring (32) need to be positioned;
- fitting the locking ring (10) onto the second drilling rig component (18) by causing the vertical (axial) splines (28*a*) associated with the locking ring (10) and vertical (axial) splines (28*b*) associated with the second drilling rig component (18) to engage, wherein the locking ring (10) slides axially along the second drilling rig component (18) until the locking ring (10) abuts with the rubber O-ring (32);
- the first drilling rig component (16) is then drawn closer towards the second drilling rig component (18) to enable the components to connect. In the embodiment shown, this connection is achieved by causing the frusto-conical projection (33) extending from the axial end (14) of the second drilling rig component (18) to be inserted into a corresponding frusto-conical bore (34) in the axial end (12) of the first drilling rig component (16);
- rotating the first drilling rig component (16) in the first direction (20) causing the first and second drilling rig components to rotatably engage, i.e. by engagement between the frusto-conical projection (33) and the frusto-conical bore (34). The rotation of the first drilling rig component (16) in the first direction draws the components closer and eventually causes the teeth (22*a*) associated with the locking ring (10) and the teeth (22*b*) associated with the first drilling rig component (16) to rotatably interact, i.e. the respective set of teeth are configured to allow further rotation of the first drilling rig component (16) in the first direction (20) but preventing rotation in the opposite direction;
- further rotation (tightening) of the first drilling rig component (16) in the first direction (20) against the second drilling rig component (18), the axial end 14 of the second drilling rig component (18) including an abutment surface (35) with which a corresponding abutment surface (36) associated with the axial end (12) of the first drilling rig component (16) comes into contact once the first drilling rig component (16) has been sufficiently tightened, the abutment surfaces (35/36) thereby preventing further rotation of the first drilling rig component (16) in the first direction (20) (as shown most clearly in the cross sectional view of FIG. 5).

Figure 3:
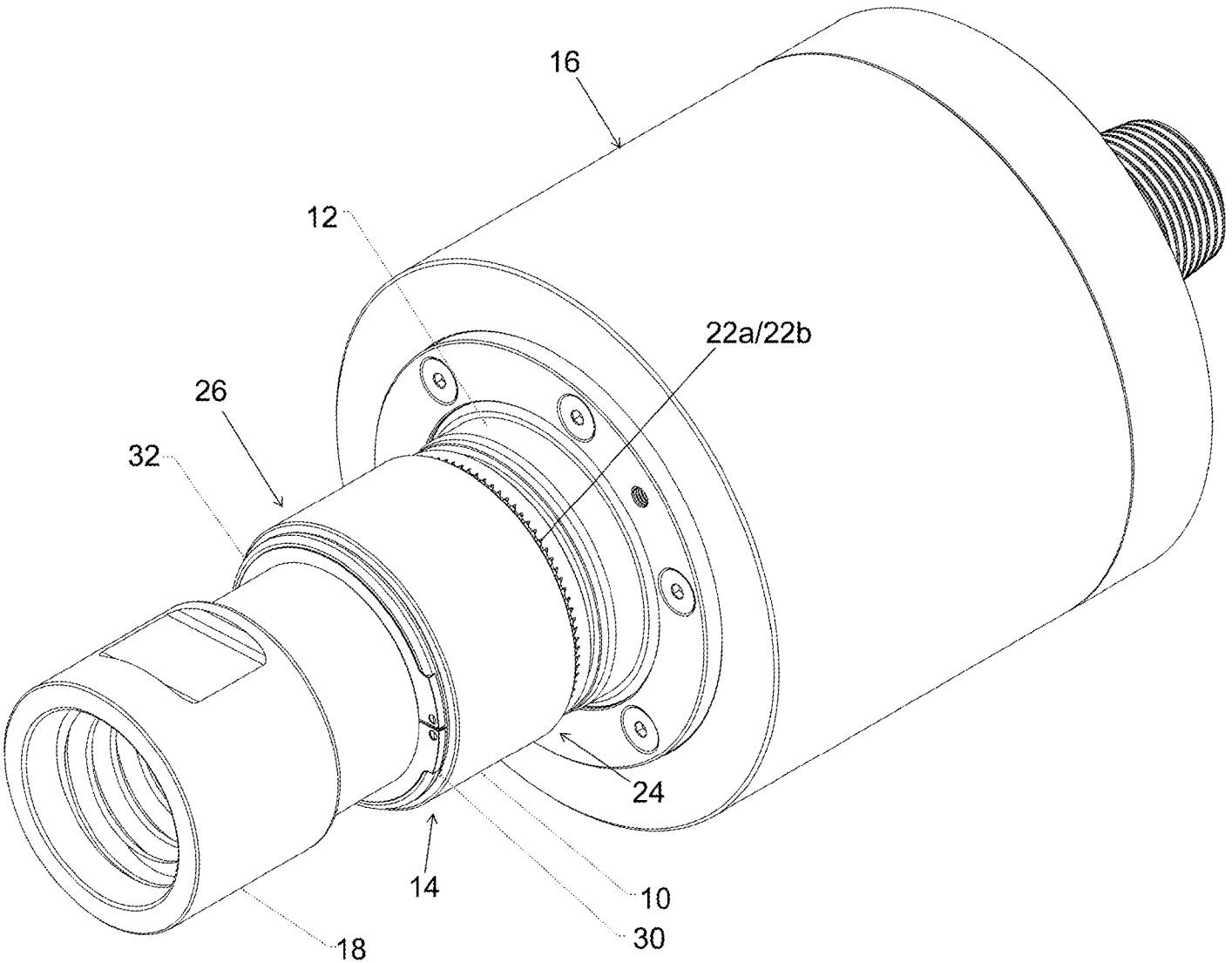
FIG. 3 illustrates a perspective view of the two components shown in FIG. 1 in an assembled state and prevented from disengagement by the locking apparatus.

The connected state between the first (16) and second (18) component is shown in FIG. 3, and it is at this point that the ratchet teeth (22*a*) and (22*b*) engage and prevent rotation of the first drilling rig component (16) in a direction opposite to the first direction (20). The location of the circlip (30) is such that its distance inward from the axial end (14) of the second drilling rig component (18) substantially corresponds with the length of the locking ring (10) such that when the locking ring (10) is mounted onto the second drilling rig component (18) (through engagement between vertical splines (28*a*) and (28*b*)), the horizontal teeth (22*a*) associated with the locking ring end (24) are substantially aligned radially with the abutment surface (35) of the second drilling rig component axial end (14). In this way, as the first drilling rig component (16) and the second drilling rig component (18) are drawn closer together towards their connected state, the teeth (22*a*) and (22*b*) associated with the ratchet type locking mechanism eventually commence their engagement to prevent rotation of the first drilling rig component (16) in the opposite direction, thereby locking the two components (16) and (18) in their connected state.

Figure 4:
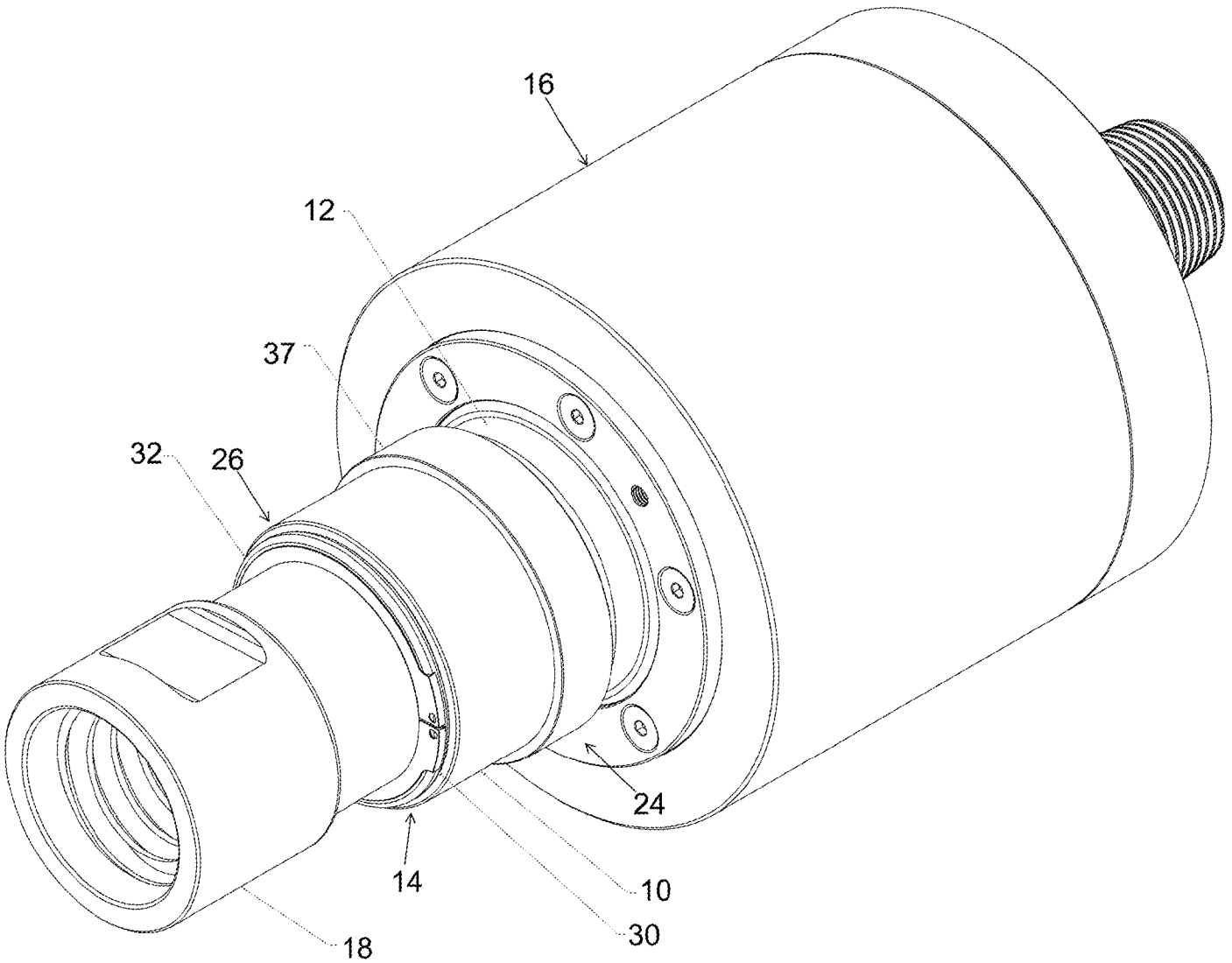
FIG. 4 illustrates the perspective, assembled view of FIG. 3 including a tooth protector associated with the locking apparatus.
Figure 5:
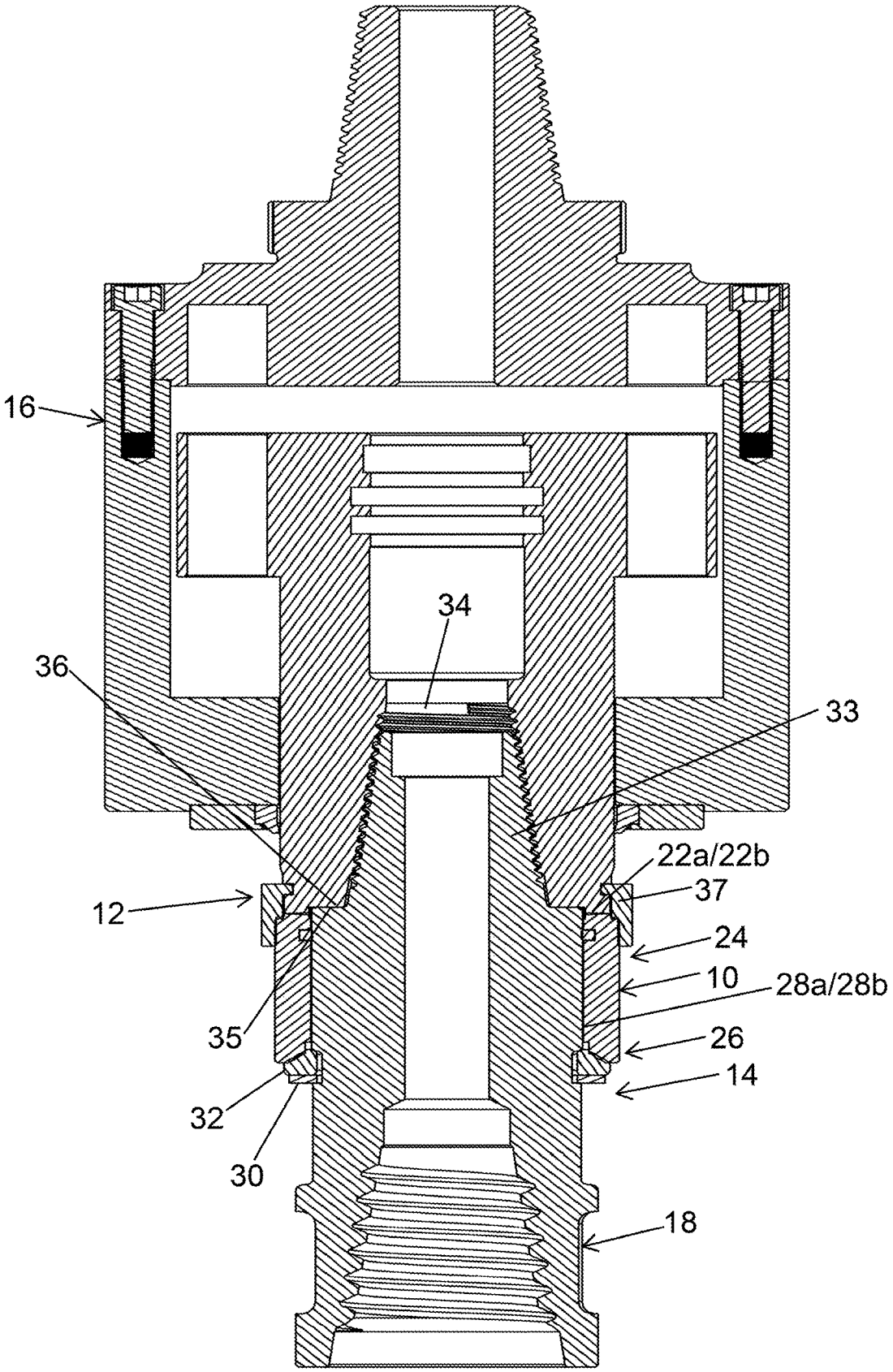
FIG. 5 a cross-sectional view of the assembled components shown in FIG. 4.

FIG. 4 illustrates the use of a tooth protector (37) which is fitted over the exposed engaging ratchet teeth (22) when the first and second drilling rig components are in a connected and locked state, to prevent ingress of dust and other material during a drilling operation.

In summary, the method by which a drilling rig comprising a first and second drilling rig component (16) and (18) may be assembled, includes mounting the locking apparatus (10) to the second drilling rig component (18) such that the locking apparatus (10) is prevented from rotation relative to the second drilling rig component (18), and connecting the first drilling component (16) to the second drilling component (18) by rotating at least the first drilling rig component (16) in a first direction (20), thereby causing the two components to rotatably engage. During rotation of the first drilling rig component (16) in the first direction (20), the ratchet type locking teeth (22*a*) associated with the locking apparatus (10) are caused to engage corresponding teeth (22*b*) associated with the first drilling rig component (16) in a manner that allows further rotation of the first drilling rig component (16) in the first direction (20) but prevents the first drilling rig component (16) from rotation in a direction opposite to the first direction (20) due to abutment between surfaces (35) and (36). The first drilling rig component (16) may then continue to be rotated and tightened against the second drilling rig component (18) until it can no longer rotate in the first direction (20). In this state, the first and second drilling rig components are effectively locked together since the first drilling rig component (16) is no longer capable of rotation in either direction. As an additional step, as described earlier, a tooth protector (37) may then be fitted over the exposed ratchet teeth (22).

The skilled addressee will appreciate that by being allowed to assemble two components of a drilling rig in this manner, an operator no longer experiences difficulties associated with having to rotate an entire component in an effort to align radially projecting splines to lock the components. Whilst the locking ring (10) along with the second drilling rig component (18) of the present invention do include vertical splines (28*a*) and (28*b*) respectively, and the splines first need to be aligned before sliding the locking ring (10) onto the second drilling rig component (18), this is not difficult to achieve in the field because this step occurs prior to the first and second drilling rig component being connected, hence the locking ring (10) is not already fixed to another component and can be manually handled at that point in the assembly process. In other words, there is no difficulty in manually aligning the splines and sliding the locking ring (10) onto the second drilling rig component (18).

In order to unlock the two drilling rig components and enable the rotation of the first drilling rig component (16) in the opposite direction, the tooth protector (37) may be removed and the circlip (30) may be disengaged. The disengagement of the circlip (30) allows the locking ring (10) to be moved axially away from the first drilling rig component (16), i.e. in the direction of the second drilling rig component (18). The ratchet teeth (22*a*) associated with the locking ring (10) and the first drilling rig component (16) may be disengaged from teeth (22*b*), enabling the first drilling rig component (16) to be rotated in the opposite direction.

Whilst the embodiment shown in FIGS. 1 to 4 illustrate a first drilling rig component in the form of a cushion sub (16) and a second drilling rig component in the form of a cross-over sub (18), as mentioned previously, the locking apparatus (10) could be used to connect other types of components associated with a drilling rig such as a rotary head, a drill rod, a drill bit, etc.

Figure 6:
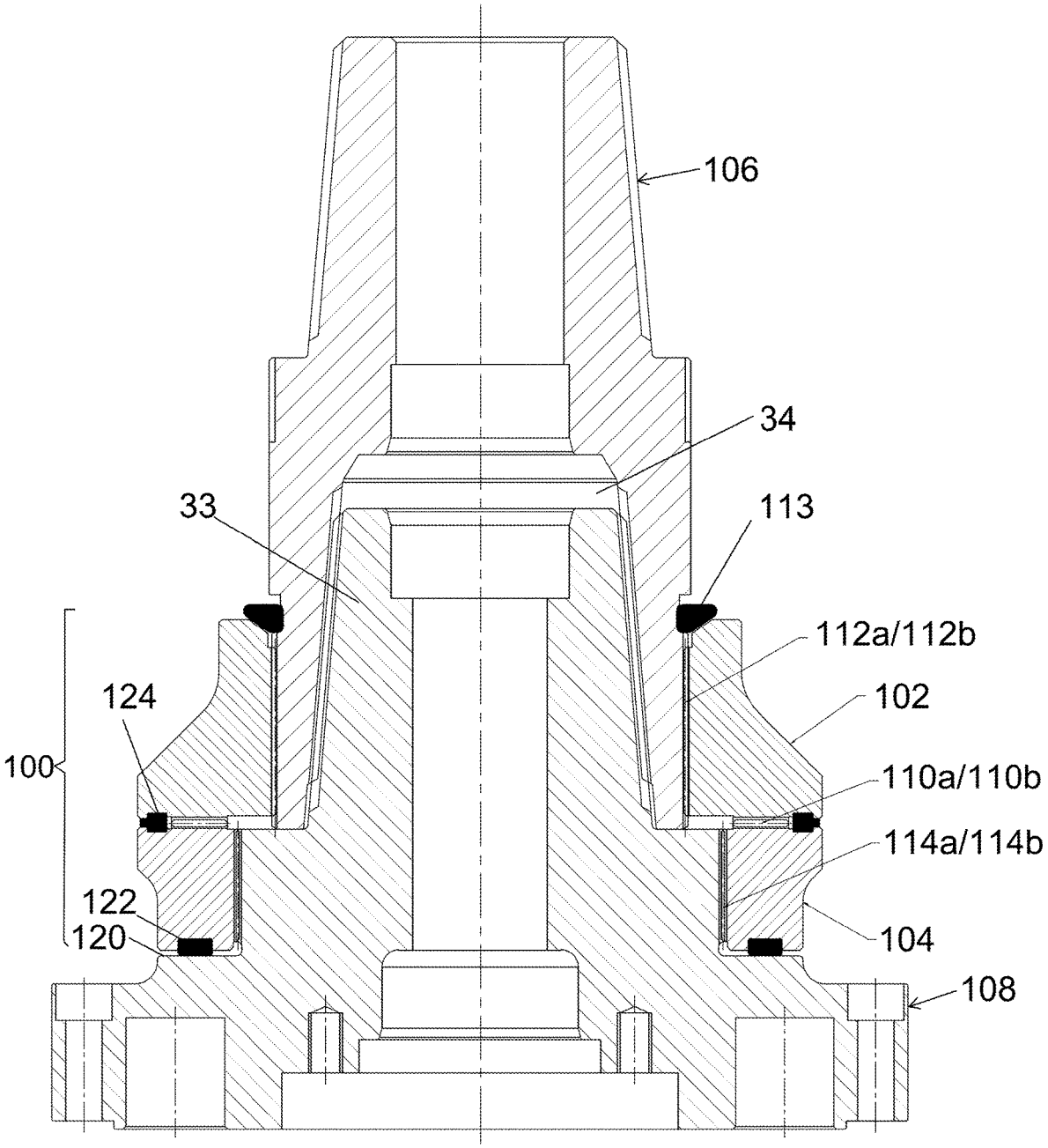
FIG. 6 illustrates two drilling rig components connected and prevented from disengaging using a first and second locking ring associated with a locking apparatus configured in accordance with an alternative embodiment.

FIG. 6 illustrates a locking apparatus (100) including a first locking ring (102) and a second locking ring (104) used to lock two drilling rig components (106) and (108) in accordance with an alternative embodiment. It should be understood that whilst an alternative embodiment is shown in FIG. 6, where certain features associated with the two components are identical or perform a similar function as features previously described with respect to the embodiment shown in FIGS. 1 to 5, the same numerals are used to reference those identical or similar features.

In the alternative embodiment of FIG. 6, the first drilling rig component (106) is a cross-over sub, and the second drilling rig component (108) is a cushion sub. In this alternative embodiment, the reader will appreciate that rather than having ratchet teeth projecting axially from the engaging end of the first drilling rig component (106), ratchet teeth (110*a*) form part of the first locking ring (102) associated with the first drilling rig component (106), such that the first locking ring (102) includes ratchet teeth (110*a*) projecting axially from the axial end thereof and thereby adapted to engage with ratchet teeth (110*b*) of the second locking ring (104) which is associated with the second drilling rig component (108).

The first locking ring (102) further includes internal vertical splines (112*a*) adapted to engage with corresponding external vertical splines (112*b*) associated with the axial engaging end of the first drilling rig component (106). The first locking ring (102) also abuts against a rubber O-ring (113) and associated circlip (not shown) journaled around the first drilling rig component (106) to prevent further sliding (axial) motion of the first locking ring (102) beyond the O-ring (113) and associated circlip when the first locking ring (102) is being fitted to the first drilling rig component (106) and during use.

The second locking ring (104) is similarly associated with the second drilling rig component (108) in that each includes correspondingly shaped, vertical splines (114*a*) and (114*b*) respectively, which are configured for engagement in a manner that allows for axial motion but not rotation motion. The second locking ring (104) includes the ratchet teeth (110*b*) for engaging with ratchet teeth (110*a*) to lock the two components together, as previously described. The second locking ring (104) is prevented from axial movement beyond the splines (towards the second drilling rig component (108)) by a shoulder (120) associated with the second drilling rig component (108) and associated O-ring (122). Similar to the tooth protector (37) in locking ring (10), the locking apparatus (100) uses a similar tooth protector (124) to protect the engaging teeth (110*a*) and (110*b*) of locking rings (102) and (104).

It will be appreciated that whilst the locking ring (100) shown in FIG. 6 is configured in an alternative manner as compared with the locking ring (10) shown in FIGS. 1 to 5 in that it comprises two locking rings (102) and (104) as compared with a single locking ring, it generally performs similar functions and addresses the same problems. In particular, the two locking rings (102) and (104) associated with components (106) and (108) respectively are able to engage (via their ratchet teeth (110*a*) and (110*b*)) and thereby lock the connection between the two components without requiring splines to be axially aligned during the locking process. The ratchet type engagement between the two locking rings facilitates the process of locking the two components in the field in that the locking is achieved during rotation of one component relative to the other (i.e. at the same time as connecting the two components). In this way, the locking occurs in a manner that does not compromise (i.e. loosen) the connection between the two components.

The steps associated with assembling the drilling rig components shown in FIG. 6 will not be described again in detail in the interest of brevity.

The skilled addressee will appreciate that in the embodiment of FIG. 6, when the drilling rig is arranged vertically and the first drilling rig component (106) is positioned above the second drilling rig component (108), the first locking ring (102) will have a tendency to slide downwards towards the second locking ring (104) during the process of connecting the two components. In order to avoid the sliding down of the first locking ring (102) a grub screw or similar retaining device (not shown) may be utilised to maintain the first locking ring (102) engaged with the first drilling rig component (106) when required.

In order to disengage the first and second drilling rig components shown in FIG. 6, the teeth (110*a*) and (110*b*) need to be disengaged and this can be achieved by, for example, disengaging the circlip associated with rubber O-ring (113).

Throughout this specification and claims which follow, unless the context requires otherwise, the word "comprise", and variations such as "comprises" and "comprising", will be understood to mean the inclusion of a stated feature or step, or group of features or steps, but not the exclusion of any other feature or step, or group of features or steps.

The reference to any prior art in this specification is not, and should not be taken as, an acknowledgement or any suggestion that the prior art forms part of the common general knowledge.

The claims defining the invention are as follows:

1. A locking apparatus for locking axial ends of first and second drilling rig components in a connected state, the connected state established by sufficiently rotating the first drilling rig component relative to the second drilling rig component in a first direction, the apparatus including:

one or more locking rings;

a first locking arrangement including:

a rachet type locking mechanism associated with a locking ring of the one or more locking rings, the rachet type locking mechanism including a set of rachet teeth, and a complementary set of rachet teeth associated with the first drilling rig component or part thereof, wherein during rotation of the first drilling rig component in the first direction, the locking apparatus is caused to engage with the first drilling rig component based on the rachet teeth engaging the complementary set of rachet teeth in a configuration that prevents the first drilling rig component from rotating in a direction opposite to the first direction, and a second locking arrangement including:

a spline type locking mechanism associated with the locking ring of the one or more locking rings, the spline type locking mechanism including a set of radially, internally projecting splines, and a complementary set of radially, externally projecting splines associated with the second drilling rig component, wherein the internally and externally projecting splines are configured to engage and thereby allow axial motion of the locking apparatus relative to the second drilling rig component whilst preventing rotational motion of the locking apparatus, including during rotation of the first drilling rig component in the first direction, the locking apparatus thereby being configured to prevent relative rotation between the first and second drilling rig components.

2. A locking apparatus according to claim 1, wherein the internally projecting splines of the locking ring of the one or more locking rings are axially aligned with and configured to engage with the externally projecting splines of the second drilling rig component.

3. A locking apparatus according to claim 2, wherein:

the locking ring encounters a circlip journaled around the second drilling rig component a predetermined distance inward from the engaging end of the second drilling rig component, the circlip preventing sliding motion of the locking ring beyond the circlip, the circlip thereby providing an abutment arrangement for the locking ring, and a rubber wedge or O-ring is disposed between the locking ring and circlip to absorb vibration and prevent wear and tear that would otherwise result from direct contact between the locking ring and circlip.

4. A locking apparatus according to claim 1, wherein the locking apparatus includes a first locking ring associated with the first drilling rig component and a second locking ring associated with the second drilling rig component, wherein the first locking means is a ratchet type locking mechanism including the set of ratchet teeth is associated with the first locking ring and is configured to engage with the complementary set of ratchet teeth which are associated with the second locking ring.

5. A locking apparatus according to claim 4, wherein each of the first and second locking rings includes a set of radially inwardly projecting splines configured to engage with a complementary set of radially outwardly projecting splines associated with the first and second drilling rig components, respectively.

6. A locking apparatus according to claim 5, wherein radially, internally projecting splines of the first locking ring of the first drilling rig component are configured to be axially aligned with and configured to engage radially, externally projecting splines of the second locking ring of the second drilling rig component.

7. A locking apparatus according to claim 6, wherein:

the first locking ring encounters a circlip journaled around the first drilling rig component a predetermined distance inward from the engaging end of the first drilling rig component, the circlip preventing sliding motion of the first locking ring beyond the circlip, the circlip thereby providing an abutment arrangement for the first locking ring, and a rubber wedge or O-ring is disposed between the first locking ring and circlip to absorb vibration and prevent wear and tear that would otherwise result from direct contact between the first locking ring and circlip.

8. A locking apparatus according to claim 4, wherein:

the second locking ring encounters a shoulder associated with the second drilling rig component a predetermined distance inward from the engaging end of the second drilling rig component, the shoulder preventing sliding motion of the second locking ring beyond the shoulder, the shoulder thereby providing an abutment arrangement for the second locking ring, and a rubber wedge or O-ring is disposed between the second locking ring and shoulder to absorb vibration and prevent wear and tear that would otherwise result from direct contact between the second locking ring and shoulder.

9. A locking apparatus according to claim 1, wherein each drilling rig component and locking ring is substantially cylindrically shaped and thereby has a substantially circular edge surface at each engaging end thereof such that when a set of ratchet teeth is associated with the engaging end, the ratchet teeth are arranged around the edge surface in a substantially circular arrangement with teeth projecting outwardly from the surface in a substantially axial direction.

10. A locking apparatus according to claim 9, wherein:

the teeth protrude axially at an angle of between 30 and 50 degrees from the edge surface.

11. A locking apparatus according to claim 1, wherein the first and second drilling rig components are connected by rotatably engaging a frusto-conical projection extending from the axial end of one drilling rig component with a corresponding frusto-conical bore in the axial end of the other drilling rig component, wherein the connected state is achieved once an abutment surface at a base of the projection comes into contact with a corresponding abutment surface at the axial end of the drilling rig component that includes the frusto-conical bore.

12. A locking apparatus according to claim 1, further including an annular protector for use when the first and second drilling rig components are locked in their connected state, the annular protector fitted over any exposed locking arrangement to prevent ingress of particles during a drilling operation.

13. A locking apparatus according to claim 1, wherein:

the first drilling rig component is a rotary head and the second drilling rig component is a cross-over sub, or the first drilling rig component is a rotary head and the second drilling rig component is a cushion sub, or the first drilling rig component is a rotary head and the second drilling rig component is a first drill rod, or the first drilling rig component is a cross-over sub and the second drilling rig component is a first drill rod, or the first drilling rig component is a cross-over sub and the second drilling rig component is a drill bit, or the first drilling rig component is cushion sub and the second drilling rig component is a first drill rod, or the first drilling rig component is a cushion sub and the second drilling rig component is a cross-over sub, or the first drilling rig component is a first drill rod and the second drilling rig component is a second drill rod, or the first drilling rig component is a first drill rod and the second drilling rig component is a cross-over sub, or the first drilling rig component is a drill rod and the second drilling rig component is a drill bit.

14. A drilling rig including:

a first drilling component, a second drilling component, and a locking apparatus for the first and second drilling components, the locking apparatus configured in accordance with claim 1.

15. A method of assembling a drilling rig configured in accordance with claim 14, the method including:

mounting the locking apparatus to the second drilling rig component such that the locking apparatus, or a locking ring associated therewith, is prevented from rotation relative to the second drilling rig component;

connecting the first drilling rig component to the second drilling component by rotating at least the first drilling rig component in said first direction and thereby causing the two components to rotatably engage, wherein during rotation of the first drilling rig component in the first direction, the first locking arrangement associated with the locking apparatus is caused to engage with the first drilling rig component in a manner that allows further rotation of the first drilling rig component in the first direction but prevents the first drilling rig component from rotation in a direction opposite to the first direction; and continuing to rotate the first drilling rig component until the first and second drilling rig components are in their connected state.

16. The locking apparatus according to claim 9, wherein the teeth protrude axially at an angle of 40 degrees from the edge surface.

* * * * *